United States Patent [19]

Kase et al.

[11] Patent Number: 4,542,620

[45] Date of Patent: Sep. 24, 1985

[54] APPARATUS FOR CLEANING A ROTOR OF AN OPEN-END SPINNING UNIT

[75] Inventors: Oldrich Kase; Stanislav Loucansky, both of Brno, Czechoslovakia

[73] Assignee: ELITEX, koncern textilniho strojirenstvi, Liberec, Czechoslovakia

[21] Appl. No.: 617,359

[22] Filed: Jun. 5, 1984

[30] Foreign Application Priority Data

Jun. 13, 1983 [CS] Czechoslovakia ..... 4262-83

[51] Int. Cl.[4] ..... D01H 7/885

[52] U.S. Cl. ..... 57/302; 57/304; 15/304

[58] Field of Search ..... 15/246, 301, 304, 395; 57/300, 301, 302, 304

[56] References Cited

U.S. PATENT DOCUMENTS

| | | | |
|---|---|---|---|
| 4,125,991 | 11/1978 | Stahlecker | 57/304 |
| 4,155,217 | 5/1979 | Stahlecker | 57/304 |
| 4,403,472 | 9/1983 | Lattion | 57/304 |
| 4,480,433 | 11/1984 | Ryer | 57/302 |

*Primary Examiner*—Harvey C. Hornsby
*Assistant Examiner*—Arthur D. Dahlberg

[57] ABSTRACT

Apparatus for cleaning the rotor of the spinning unit for the open-end spinning of yarn. The apparatus has a cleaning head with cleaning elements arranged in the form of a rotary brush mounted upon a rotatably driven shaft. In the cleaning head, at the rear side of the brush, there is provided at least one projection which deflects or bends the bristle of the brush axially outwardly at intermediate portions thereof so as to reduce their effective diameter so as to enable them to penetrate into the inlet opening of the spinning rotor.

6 Claims, 4 Drawing Figures

APPARATUS FOR CLEANING A ROTOR OF AN OPEN-END SPINNING UNIT

The present invention relates to an apparatus for cleaning spinning rotors of open-yarn spinning units. The apparatus has a cleaning head provided with cleaning elements made in the form of a brush which is attached to a mounting and driving shaft, the brush cooperating with suction means provided in the body of the cleaning head.

In textile machines for open-end spinning of yarn, provided with spinning rotors, the spinning rotors are soiled and fouled by dust, organic remains of cotton balls, residues of dressings applied to the fibers during their processing, and, upon stoppage of the spinning units, with the remains of the fibers proper. The impurities thus deposited in the spinning rotors have a deleterious effect on the technological process of yarn formation, and detrimental mechanical effects on the mounting of the rotor in its bearings. In cases in which the impurities deposited in the rotor exceed a tolerable limit, the spinning process is interrupted or an intolerable deterioration of the yarn produced by the unit occurs.

In the present state of the yarn the cleaning of open-end spinning rotors is carried out in a number of different ways, for example, manually, with the aid of small brushes inserted into the rotors and positively rotated, and the like. Disadvantages of the devices presently in use reside in the contamination of the cleaning device itself, particularly with fibrous residuals, a low efficiency of cleaning, wear on the spinning rotor under the effect of the cleaning device, and, particularly a low efficiency in removing hard deposits from the collecting groove of the rotor.

Cleaning devices employing brushes are excessively complicated because it is necessary to impart a circulating motion to the shaft carrying the brush, so as to enable the brush, which has a diameter smaller than the inlet opening of the spinning rotor, also to clean the collecting groove, the latter being located at the bottom of a frusto-conical hollow in the spinning rotor.

It is an object of the apparatus of the present invention to eliminate the disadvantages of the rotor cleaning systems now in use. In accordance with the invention, at the rear side of a brush, on the body of a cleaning head, there is at least one projection which is oriented transversely of the plane of motion of the cleaning elements of the brush. Such projection bends the cleaning elements, such as bristles, so that the bristles enter the outer, smaller diameter, end of the rotor as the brush rotates, whereby the bristles then penetrate into the rotor so as to reach and operate upon the collecting groove therein.

The effects of the apparatus of the present invention make themselves felt particularly because the operation of cleaning the rotor takes place without the necessity of driving the rotor from the outside; as a result, possible damage to or excessive wearing of the working surface of the rotor is eliminated. By a suitable choice of the material from which the cleaning elements are made, it becomes possible to meet any requirements as to the intensity of cleaning of the working surface of the rotor as well as the collecting groove therein. Due to the folding or bending of the cleaning elements when the cleaning device enters the spinning rotor, the cleaning elements are able fully to enter the spinning rotor and reach the collecting groove therein without the provision of any further mechanism to achieve such result, all while a high quality of cleaning is attained. By utilizing the constructional solution of the invention, a self-cleaning effect is obtained for the cleaning elements themselves. Further, a positive economic benefit is achieved thereby, due to reduced requirements on the maintenance of the cleaning apparatus, as well as an increase in the reliability of operation thereof and an increase in the quality of the cleaning of open-end spinning rotors.

Other effects of the present invention will become apparent from the following description of a preferred embodiment thereof, given by way of example, as shown in the accompanying drawings, in which.

Figure 1:
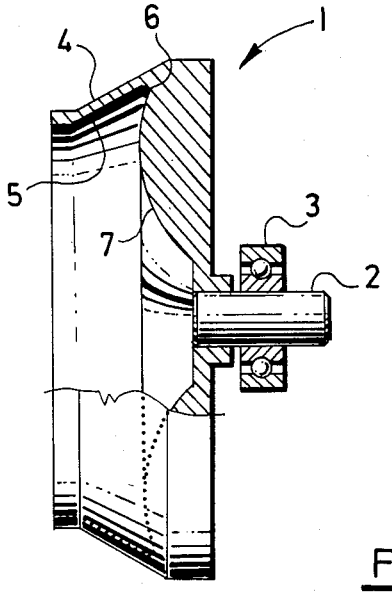
FIG. 1 is a view partially in axial section and partially in side elevation of a rotor of an open-end spinning unit.
Figure 2:
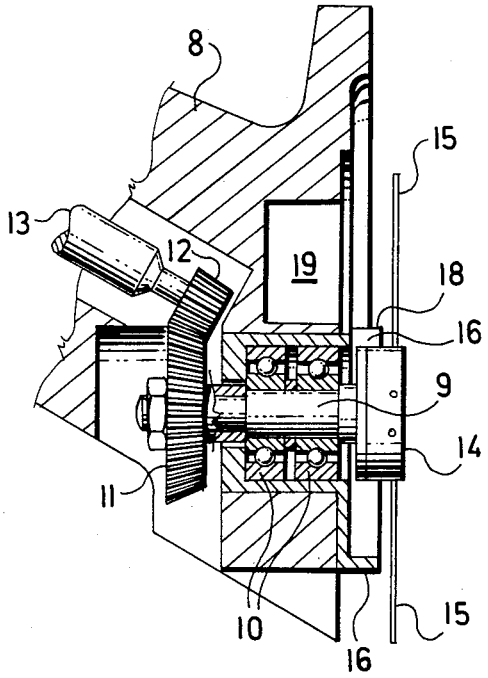
FIG. 2 is a view partially in axial section and partially in side elevation of a rotor cleaning apparatus in accordance with the invention.
Figure 4:
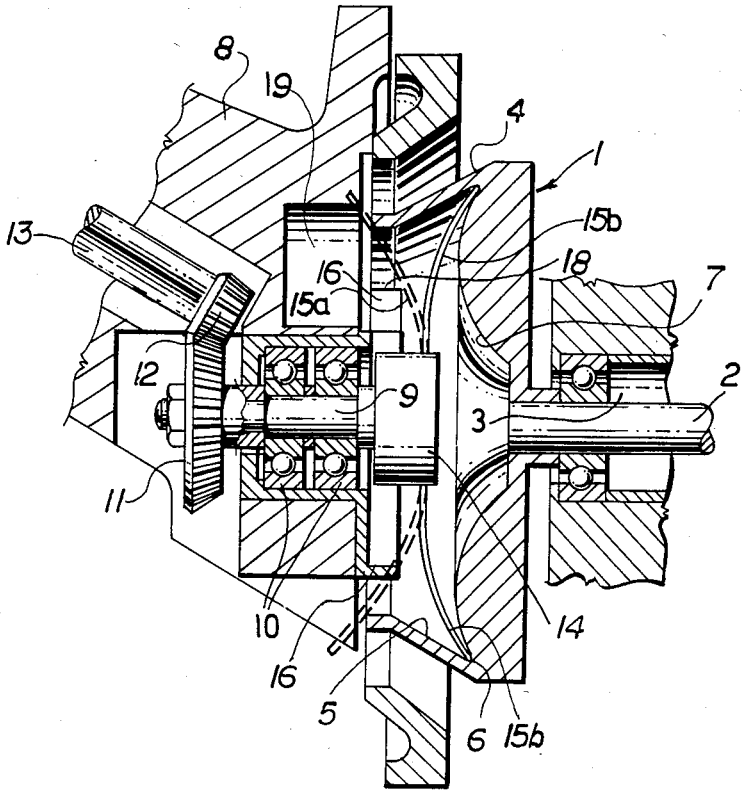
Figure 3:
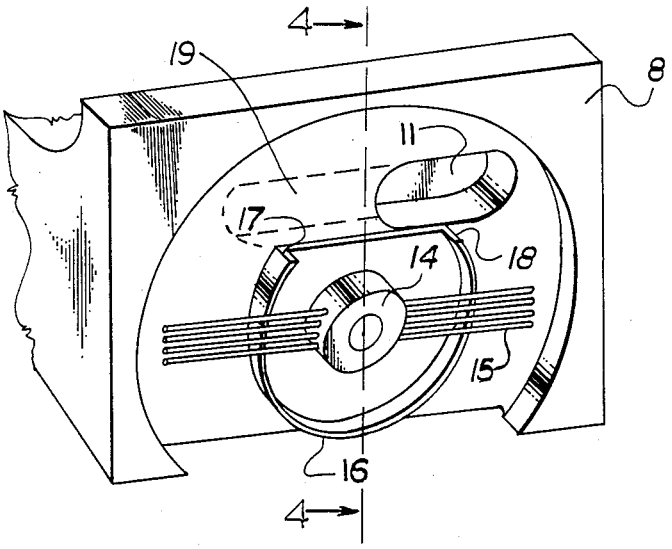

FIG. 3 is a view in front perspective of the cleaning apparatus of FIG. 2; and FIG. 4 is a view partially in axial section and partially in side elevation of the cleaning apparatus applied to the rotor of FIG. 1, FIG. 4 illustrating the phantom lines the manner in which the cleaning elements such as bristles are first folded or bent as they are first partially introduced into the spinning rotor, and the shape, shown in full lines which they finally assume after they have been fully inserted into the interior of the spinning rotor.

Turning first to FIG. 1, reference character 1 designates the rotor of a typical open-end spinning unit. Rotor 1 is mounted upon a shaft 2 which is mounted for rotation in a bearing 3. During a spinning operation, rotor 1 is rotated at high speed by driving means (not shown). The rotor has a generally frusto-conical circumferential flange from which after an axially short circular cylindrical portion, the rotor flares or increases to the right in a frusto-conical portion 4. The inner surface of the portion 4 of the rotor 1 extends to a circumferentially extending yarn and fiber collecting groove 6. The bottom or inner end of the space within the rotor 1 is in the form of a part-toroidal shape 7 which has a rounded portion thereof facing outwardly of the opening into the rotor.

FIGS. 2 and 3 illustrate the apparatus of the invention for cleaning the rotor 1. Such apparatus has a cleaning head or frame 8 in which there is mounted, in bearings 10, a brush mounted and driving shaft 9. Shaft 9 has a bevelled gear 11 fixedly secured thereto at its outer or left-hand end, gear 11 meshing with a pinion 12 mounted upon a shaft 13. Shaft 13 is mounted in bearings (not shown) disposed in the head 8, and is driven by means such as a electric motor (also not shown). A brush having a central hub or core 14 is fixedly secured to the right-hand end of shaft 9, a plurality of cleaning elements such a flexible bristles 15, being secured to and extending radially from the hub 14. Bristles 15 may be made for example of monofilament or polyfilament fibers, the radial length of which when the bristles are relaxed, as shown in FIG. 2, exceeding the radius of the opening at the left-hand end of the rotor 1 into the space there within. The radial length of the relaxed bristle 15 is also greater than the radius of the collecting groove 6 of the spinning rotor 1.

As shown in FIG. 2, and more particularly in FIG. 3, the hub 14 of the brush is partially surrounded by a collar 16, collar 16 terminating at a level somewhat above the hub 14 of the brush and a first end edge 17 at the left and a second end edge 18 at the right, there thus being formed an appreciable gap in the collar 16. As shown in FIG. 2, the axially outer free edge of the collar 16, in the embodiment shown, lies in a plane transverse to the axis of the shaft 9 which extends through the hub 14 axially inwardly or to the left of the roots of the bristle 15, as shown in FIG. 2. Thus in their relaxed condition, when the cleaning head is not applied to a rotor, the bristles 15 do not engage the collar 16. Positioned above and rearwardly of (to the left in FIG. 2) the brush 14, 15 and the gap in collar 16 there is a suction inlet 19 in the cleaning head 8 to exhausts impurities. The incomplete collar 16 disposed on the cleaning head 8 also suitably directs the airflow into the suction inlet 11 during the cleaning of the spinning rotor 2. Suction inlet 19 is connected to a suitable source of sub-atmospheric pressure (not shown).

The above described cleaning apparatus operates as follows: After the rotor 1 has been brought to a halt, the rotor cleaning apparatus is applied thereto with the shaft 9 and brush 14, 15 coaxial of the rotor 1, preferably with the shaft 9 and the brush 14, 15 having first been put in motion. Upon application of the cleaning apparatus the rotor 1 as shown in FIG. 4, the cleaning element, that is, bristles 15 first touch the front of the rotor 1 and, as the movement of the cleaning apparatus toward the spinning rotor is continued, the cleaning elements 15 are deflected toward the collar 16, as indicated by the phantom-line position 15*a* (FIG. 4) after which the deflected bristle 15 are engaged by either of the edges 17 and 18 of the collar 16, depending upon the direction of rotation of the shaft 9 and the brush 14, 15.

The simultaneous action of the effective rotation of the brush and of the edges 17, 18 of the incomplete collar 16 results in the bending of the bristles 15 on the edge 17 or 18, in a direction opposite to the direction of rotation of the brush to reduce the bristles, as shown in full lines in FIG. 4, to an effective radius, defined by the inner radius of the incomplete collar 16. At the same time, during the first part of this movement, the bristles 15 skid over the edge 17 or 18, whereby the impurities adhering to the surface of the cleaning bristles 15, for example, remains of fibers and dust, are stripped off. Upon further advance of the cleaning head 8 into the interior of the spinning rotor 1, the bristles 15, due to their inherent resilience, tend to assume their original position. Under the effect of the conicity of the inner space of the spinning rotor 1 and the rotation of the brush 14, 15, the bristles 15 assume a (full line) position 15*b* which they maintain even during backward movement of the cleaning head 8 with the bristles 15 and the hub 14 of the brush out of the interior of the spinning rotor 1. During said backward movement, the bristles 15 uniformly clean the inner surface of the spinning rotor 1 from the impurities which have been deposited therein. These released impurities are exhausted through the suction inlet 11.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. Apparatus for cleaning the interior of a hollow rotor of a spinning unit for the open-end spinning of yarn, comprising a cleaning head provided with cleaning elements assembled into the form of a rotary brush with bristles, the brush being attached to a shaft rotatably mounted in the head and connected to an outer drive, suction means provided within the body of the cleaning head, at least one projection at the rear side of the brush, on the body of the cleaning head, the projection being oriented transversely of the plane of movement of the bristles of the brush and outwardly of the head, whereby to bend bristles so that they enter the interior of the hollow rotor.

2. Apparatus as claimed in claim 1, wherein around the shaft, at the rear side of the brush, on the body of the cleaning head, there is an incomplete collar with a circumferential gap, the edges of the collar which bound the gap constituting projections having the form of transverse edges which constitute bristle bending projections.

3. Apparatus as claimed in claim 1, wherein the at least one projection on the body of the cleaning head, designed to bend the bristles of the brush, is disposed within the effective suction area of a suction inlet in the cleaning head.

4. Apparatus as claimed in claim 1, wherein the bristles of the brush are fibers composed of at least one filament, the length of the fibers being greater than the radius of the inlet opening into the interior of the hollow spinning rotor.

5. Apparatus as claimed in claim 1, wherein the spinning rotor to be cleaned has a fiber collecting groove therein, and the length of the cleaning elements of the brush of the cleaning apparatus is greater than the radius of the collecting groove in the spinning rotor.

6. Apparatus as claimed in claim 1, wherein, when the cleaning device is operatively mounted relative to the rotor of a unit which is to be cleaned, the axis of rotation of the bristles of the brush coincides with the axis of rotation of the spinning rotor.

* * * * *